US005429034A

United States Patent [19]

Badali et al.

[11] Patent Number: 5,429,034

[45] Date of Patent: Jul. 4, 1995

[54] FIRE ARM

[75] Inventors: Joseph A. Badali, Ogden; Joseph F. N. Rousseau, Mountain Green, both of Utah

[73] Assignee: Browning S.A. societe anonyme, Herstal, Belgium

[21] Appl. No.: 275,381

[22] Filed: Jul. 15, 1994

[30] Foreign Application Priority Data

Jul. 16, 1993 [BE] Belgium ..... 09300749

[51] Int. Cl.[6] ..... F41A 5/18

[52] U.S. Cl. ..... 89/193; 89/191.02; 89/192

[58] Field of Search ..... 89/193, 191.02, 191.01

[56] References Cited

U.S. PATENT DOCUMENTS 3,020,807 4/1958 Hailston et al. ..... 89/193
3,601,002 8/1971 Janson .
3,968,727 7/1976 Hyytinen ..... 89/191 A
3,990,348 11/1976 Vesamaa .
4,085,654 4/1978 Panigoni ..... 89/191 A
4,125,054 11/1978 Jennie .
4,702,146 10/1987 Ikeda et al. ..... 89/193
4,872,392 10/1989 Powers et al. ..... 89/193
4,901,623 2/1990 Lee ..... 89/193
5,218,163 6/1993 Dabrowski ..... 89/193

*Primary Examiner*—Charles T. Jordan
*Assistant Examiner*—Christopher Keith Montgomery
*Attorney, Agent, or Firm*—Bacon & Thomas

[57] ABSTRACT

An improved semi-automatic shotgun of the type contains a magazine tube (8) around which is provided a cylinder (9) whose interior part communicates with an interior part of a barrel (2) of the invention. In this cylinder (9) and around the magazine tube (8), a piston (10) can be shifted by propulsion gases. The piston cooperates with a sleeve (12) provided with a rod (13) which can act upon the whole of the moving parts (14) on the one hand, and a control or pressure control valve (11) on the other hand is situated in the piston block (10).

16 Claims, 4 Drawing Sheets

FIRE ARM

BACKGROUND OF THE INVENTION

The present invention concerns improved semi-automatic fire arms, in particular the gas aperture systems of such guns.

It is known that in gas aperture or gas inlet mechanisms, part of the propulsion gases of the cartridge is diverted from the barrel of the arm through an opening called a gas aperture towards a cylinder/piston unit.

This piston moves in cylinder due to the pressure of the gases and exerts a thrust on a sleeve equipped with one or several rods which send the whole of the moving parts backwards so as to carry out the different ejection functions of the fired case, the recock of the firing system as well as the feeding of a subsequent cartridge to the barrel block.

The above-mentioned system contains a return spring which acts on the piston in order to re-position the piston.

SUMMARY OF THE INVENTION

The invention concerns improvements to such a gas aperture mechanism whereby the whole of the parts is placed coaxially and externally in relation to the magazine tube which contains the firing cartridges.

The gas aperture mechanism of the invention also contains a control valve or pressure control valve kept in position by means of a spring.

This valve is designed to let part of the gases coming from the barrel of the arm escape in case there is too much pressure, for example when so-called "Magnum" cartridges are being fired.

This escape of gas, for example through an opening bored in the lateral wall of the cylinder, limits the pressure on the piston and prevents the moving parts from gaining too much speed, which could harm the reliability of the arm or which could lead to an excessive wear of the moving parts.

The invention is further directed to a regulating gas aperture with several new characteristics.

A first characteristic according to the invention consists in the fact that the pressure control valve is situated in the piston unit, which allows for a very simple, efficient and compact construction.

Another characteristic according to the invention consists in the fact that, in order to let excess pressure escape, the valve carries out a relative movement in relation to the piston, and this movement is carried out in the same sense and the same direction as the active movement of the piston, which results in a reduced recoil force.

An improved shotgun according to the invention contains a magazine tube around which is provided a cylinder whose interior part communicates with the interior part of the barrel, and in this cylinder and around the magazine tube, a piston which can be shifted by part of the propulsion gases and which can work in conjunction with a sleeve provided with one or several rods which can act upon both the moving parts of the shotgun, and a control or pressure control valve. Springs are provided as a control for the return of the sleeve and of the control valve which is situated in the piston block.

BRIEF DESCRIPTION OF THE DRAWINGS

In order to better explain the above-mentioned and other characteristics of the invention, the following example is given with reference to the accompanying drawings, where.

DETAILED DESCRIPTION OF THE PREFERRED EMBODIMENT

Figure 1:
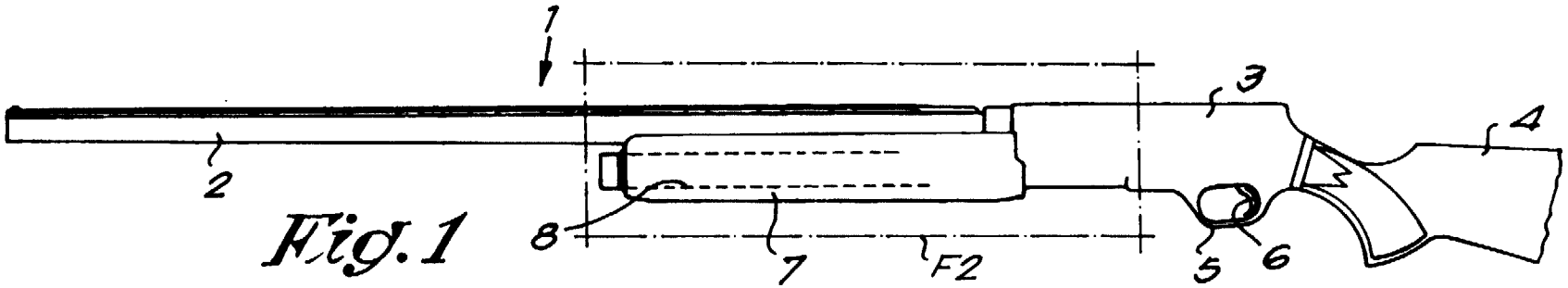
FIG. 1 represents a semi-automatic shotgun with the improvements according to the invention.
Figure 2:
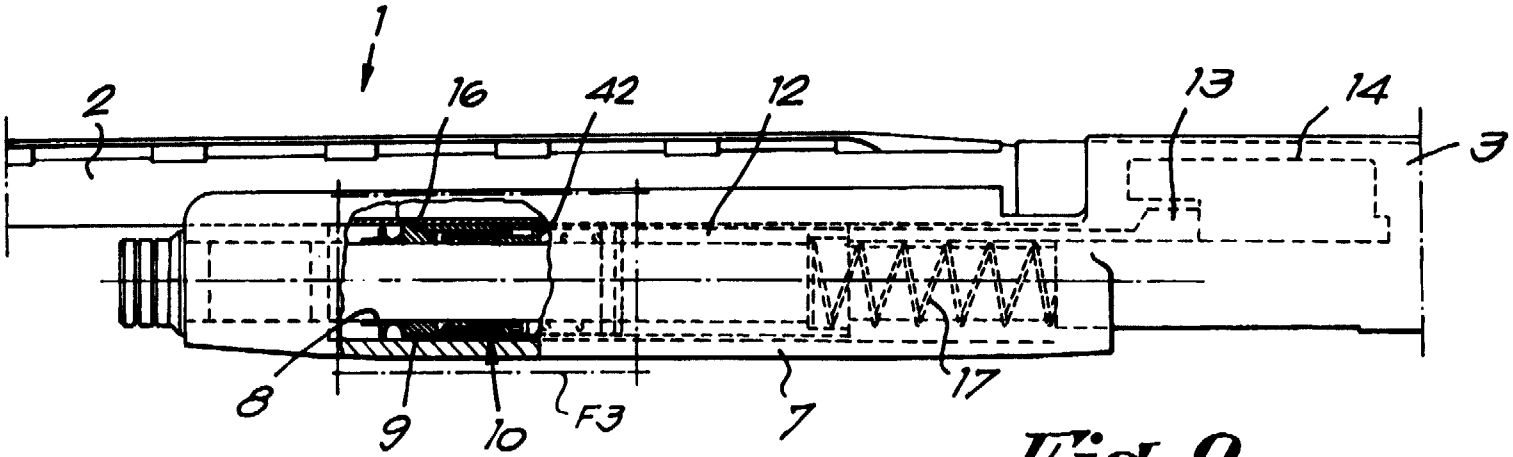
FIG. 2 represents a partial section of the part indicated by F2 in FIG. 1 to a larger scale.
Figure 3:
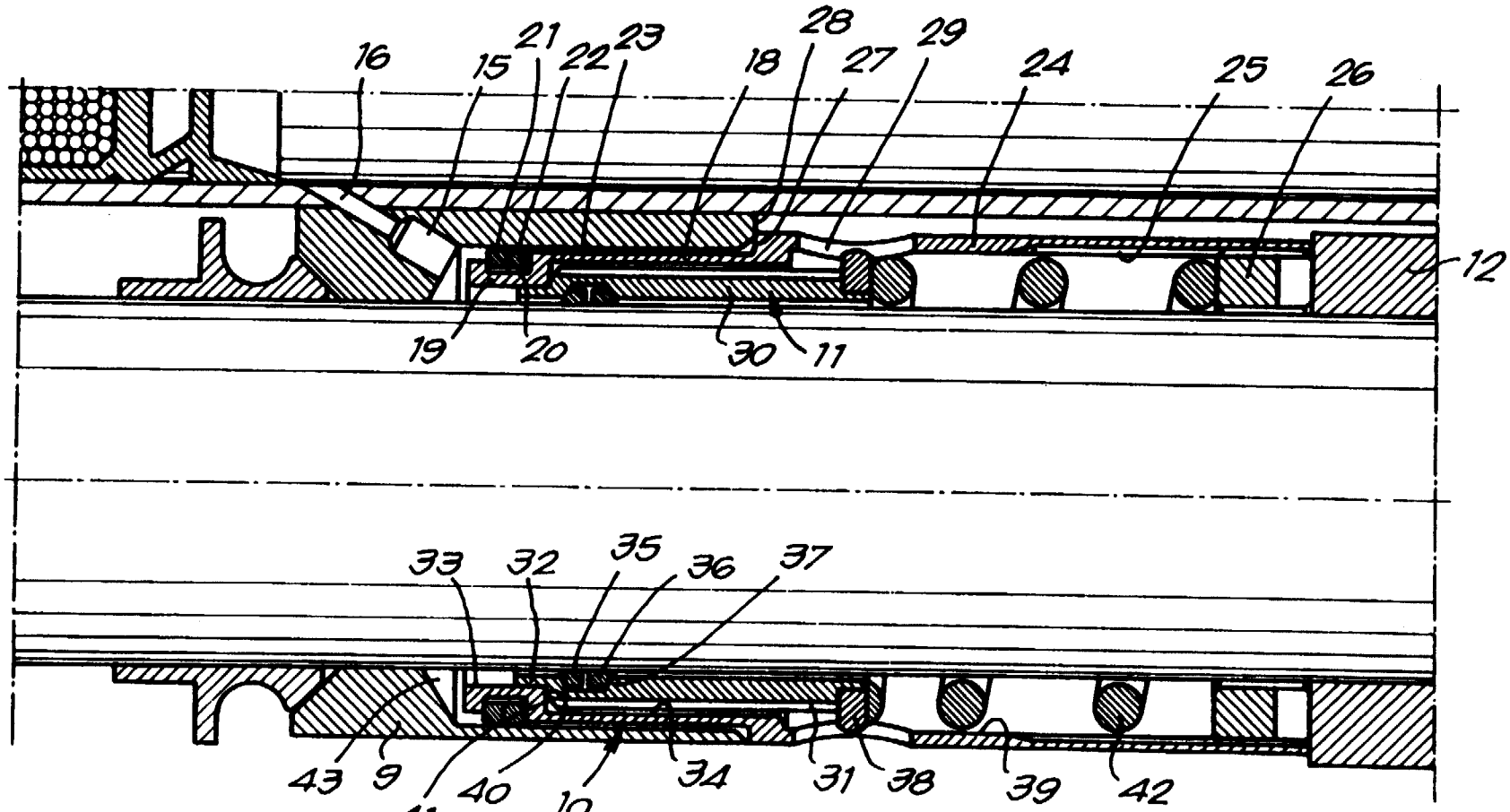
FIG. 3 represents the part indicated by F3 in FIG. 2 to a larger scale, whereby the piston and valve are in rest position.

The semi-automatic shotgun 1 as represented in FIG. 1 is mainly composed of the barrel 2, the casing 3, the butt 4, the trigger guard 5 with the trigger 6 and the handshield 7 with the incorporated magazine tube 8.

Around the magazine tube 8 are mounted in the handshield 7, successively, a gas cylinder 9 fixed to the barrel 2, incorporating a piston 10 and a control valve or pressure control valve 11, and a sleeve 12 which makes contact with piston 10 and which is fixed to a rod 13 whose free end makes contact with the whole 14 of the moving parts of the arm.

In a conventional manner, the interior part of the cylinder 9 communicates with the interior part of the barrel 2 by means of coaxial openings 15 and 16 respectively.

The sleeve 12 is continuously pushed against the piston 10 by means of a return spring 17.

According to the invention, the piston 10 mainly consists of a first pipe 18 having towards its front end a part of a smaller diameter 19 in which is provided a circular duct 20 with two O-rings 21–22 respectively, which form a guiding element for the piston 10 in the bore 23 of the cylinder 9, and of a second pipe 24 having a larger diameter whose rear end contains a threaded part 25 which works in conjunction with a threaded ring 26.

The pipe 24 forms an edge 27 in relation to the pipe 18 which can work in conjunction with the rear end 28 of the cylinder 9, and second pipe 24 also has voiding holes 29 situated at the front thereof.

The control valve or pressure control valve 11 which is placed coaxially in the piston unit 10 consists of a pipe 30 having longitudinal grooves 31 on its outer surface, whereby pipe 30 is guided with its foremost part having a smaller diameter 32 in the bore 33 of the pipe 19 of the piston 10, with the outer surface of the grooves 31 in the bore 34 of pipe 18, with O-rings 35–36 situated in a circular cavity 37 in the pipe 30 on the magazine tube 8 and with a support ring 38 for a return spring 42 fixed on the rear end of the pipe 30 in the bore 39 of the pipe 24 of the piston 10.

The pipe 30 also has a stop 40 which can work in conjunction with a circular surface 41 of the piston 10 under the influence of the return spring 42 situated in the pipe 24 of the piston 10 between the support ring 38 which rests on the rear part of the pipe 30 of the valve 11 and the above-mentioned ring 26 fixed in the pipe 24 of the piston 10.

The force exerted by the spring 42 on the valve 11 can be controlled by means of the ring 26 which can be moved in relation to the pipe 24 of the piston 10.

The working of the mechanism according to the invention is very simple and as follows.

In a conventional manner, part of the propulsion gases of the cartridge is diverted from the barrel 2 through the openings 15–16 towards the piston 10, thus making the latter move, which results in a thrust on the sleeve 12 and thus on the rod 13 which subsequently acts with its free end on the whole of the moving parts 14 which carry out in a known manner the different ejection functions of the fired case, the recock of the firing system and the feeding of the subsequent cartridge to the barrel block, after which, by means of the return spring 17, the piston 10 is put in place again.

Figure 4:
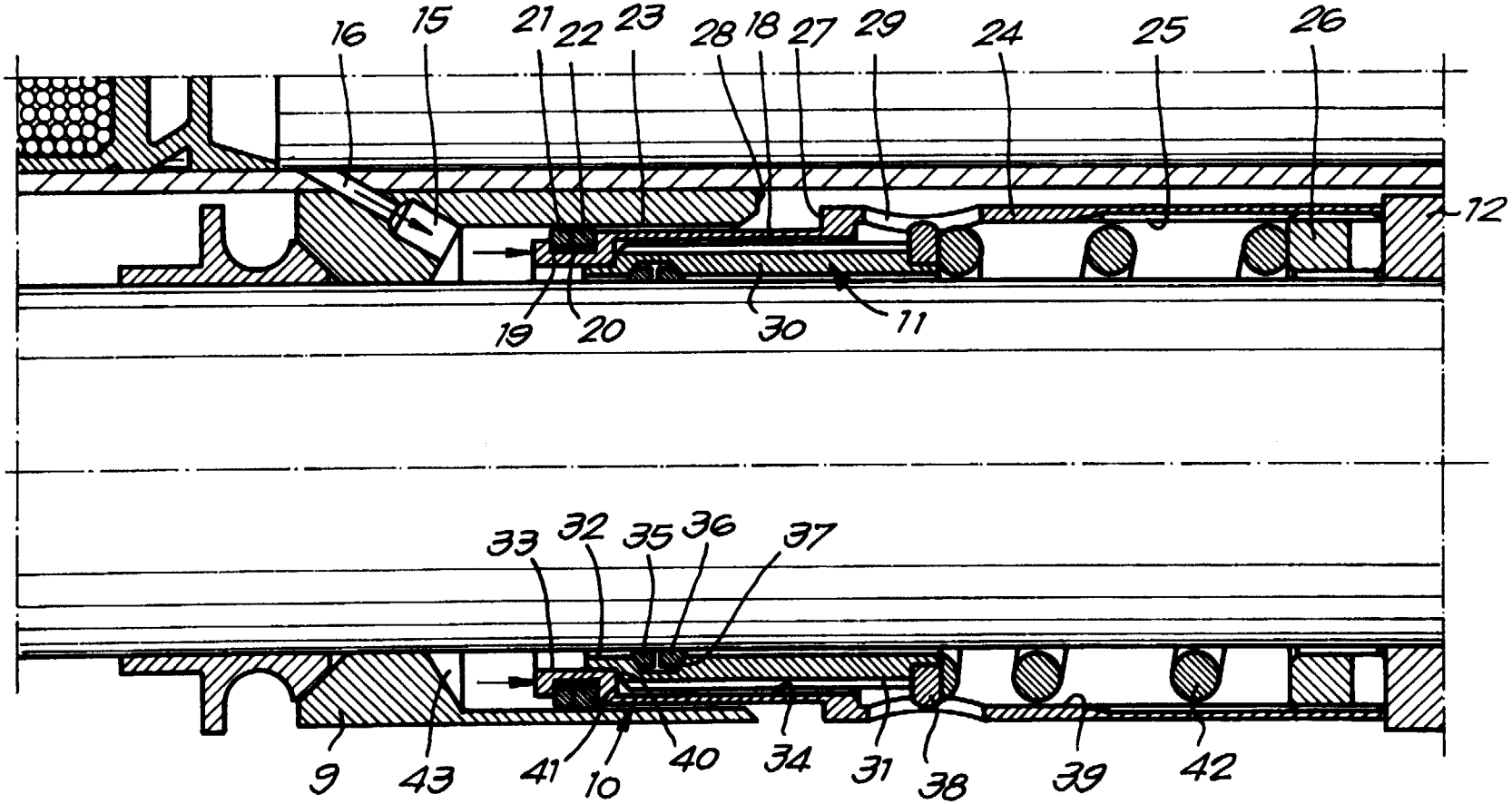
FIG. 4 shows a view comparable to that in FIG. 3, whereby the piston, and valve are in a position corresponding to that when light cartridges are being fired.

When light cartridges are being fired, the spring 42 is calibrated such that the control valve or the pressure control valve 11 is kept against the wall 41. Hence, the propulsion gases entering in the cavity 43 of the cylinder 9 act on the front surfaces of both the piston 10 and the valve 11. They thus control the moving parts 14 as mentioned above. This situation is illustrated in FIG. 4.

Figure 5:
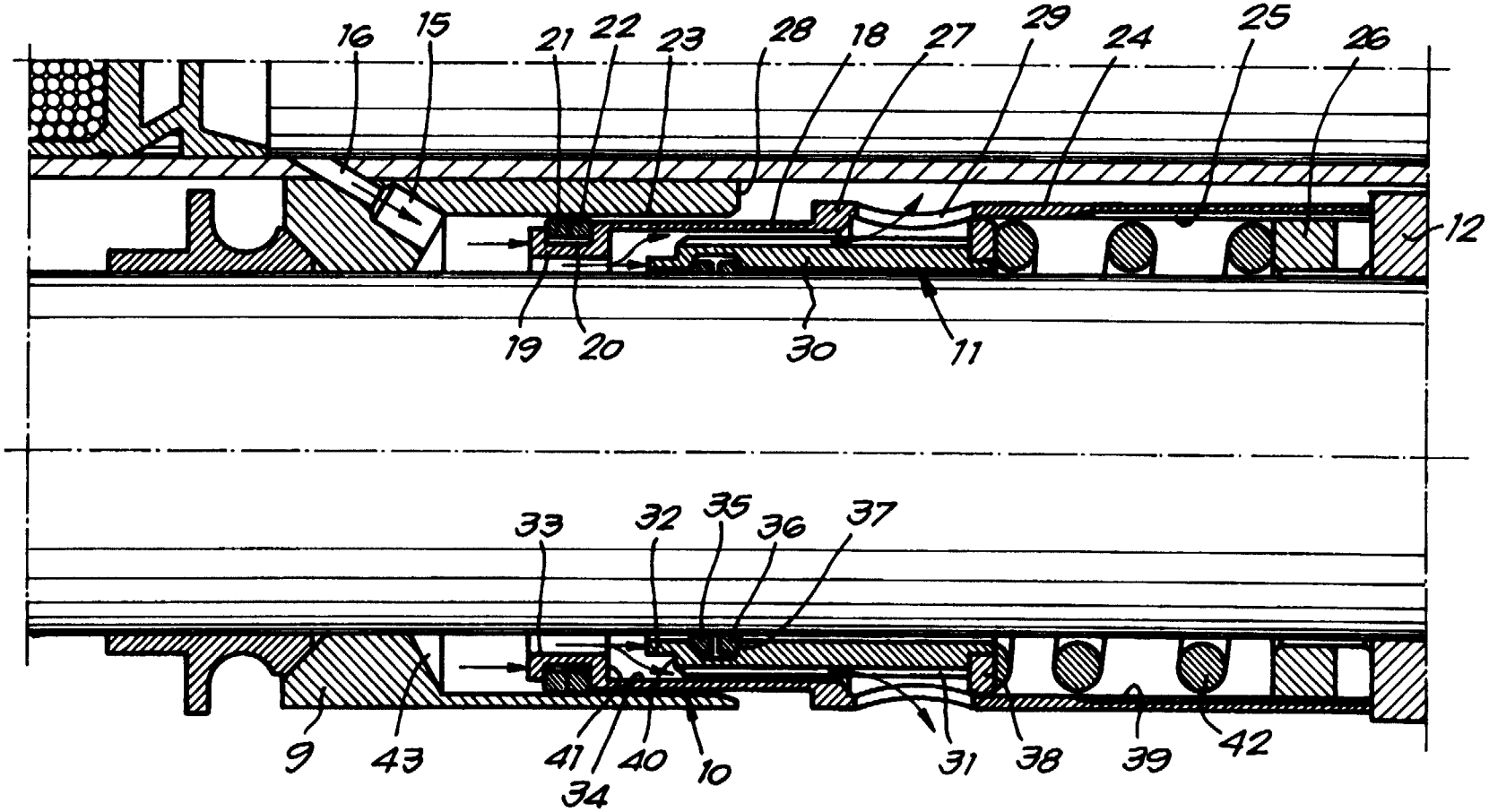
FIG. 5 shows a view comparable to that in FIG. 3, whereby the piston and valve respectively are in a position corresponding to that when "Magnum" cartridges are being fired.

When so-called "Magnum" cartridges are being fired, part of the gases coming from the barrel act on the piston 10 on the one hand, and on the valve 11 on the other hand, and, since more pressure is exerted on the spring 42 then when light cartridges are being fired, one obtains not only an axial movement of the piston 10 thus resulting in the control of the moving parts 14, but also a relative axial movement of the valve 11 in relation to the piston 10, in such a manner that part of the gases coming from the barrel 2 can escape through the voiding holes 29 provided in the pipe 24 of the piston 10. This situation is illustrated in FIG. 5.

Thanks to the escape of part of the gases through the holes 29, the pressure deviations on the piston 10 are reduced, which favours the constant speed of the movement of the moving parts 14 and prevents excessive speeds of movement which could harm the reliability of the arm or which could lead to an excessive wear of the moving parts.

As the working of the semi-automatic shotgun is entirely similar to the working of the existing guns, the gun according to the invention has as advantages an improved tightness; a simple, efficient and compact construction; and a movement of the piston 10 and the valve 11 carried out in the same sense and the same direction, which results in a reduced recoil force.

It is clear that the invention is by no means limited to the example described above and illustrated in the accompanying drawings; on the contrary, modifications can be made to this example, in particular as far as the nature and morphology of the arm in question is concerned, while still remaining within the scope of the invention.

Thus, among others, the sealing elements, namely the O-rings can be replaced by other sealing systems, for example grooves; the cylinder/piston/valve unit can be placed either around the standard magazine as described above or before the tube, next to the tube or also on a part of this tube; the spring which maintains the valve 11 against the piston 10 should not necessarily be a conventional compression spring, etc.

We claim:

1. A semi-automatic shotgun comprising:

a barrel having an associated interior;

a magazine tube positioned adjacent said barrel;

a cylinder extending about said magazine tube, said cylinder including an interior portion in fluid communication with the interior of said barrel;

a piston positioned within the interior portion of said cylinder and extending about said magazine tube, said piston being movable relative to said cylinder by means of pressure applied thereto by propulsion gases flowing from the interior of said barrel to the interior portion of said cylinder;

a sleeve and rod assembly attached for movement with said piston, said sleeve and rod assembly also being connected to a loading assembly of said shotgun;

control valve means for regulating the pressure applied to said piston by the propulsion gases, said control valve means being located within said cylinder with both said control valve means and said piston being movable relative to said cylinder and at least a portion of said control valve means being movable relative to said piston; and biasing means acting between said sleeve and said control valve means for applying a biasing force to close said control valve means.

2. A shotgun according to claim 1, wherein said control valve means comprises a valve member coaxially arranged relative to said piston within said cylinder.

3. The shotgun according to claim 1, wherein said control valve means comprises a valve member arranged inside said piston.

4. The shotgun according to claim 1, wherein said piston is arranged between said cylinder and said sleeve.

5. The shotgun according to claim 1, wherein said control valve means is movable between a rest position and a control position, said control valve means abutting said piston in its rest position.

6. The shotgun according to claim 4, wherein said biasing means comprises a spring and acts between said sleeve and said control valve means to bias said control valve means into engagement with said piston.

7. The shotgun according to claim 5, further comprising a return spring biasing said piston towards a terminal wall of said cylinder.

8. The shotgun according to claim 1, wherein said cylinder defines a bore and said piston comprises a first pipe situated within said bore and a second pipe, said second pipe having an associated diameter that is larger than a diameter associated with said first pipe such that a stop is formed between said first and second pipes, said stop being adapted to engage said cylinder when said piston is in a rest position.

9. The shotgun according to claim 8, wherein said second pipe is formed with a plurality of spaced through holes.

10. The shotgun according to claim 8, further comprising an O-ring provided about the first pipe of said piston.

11. The shotgun according to claim 10, further comprising a cavity formed in the first pipe of said piston, said O-ring being situated within said cavity.

12. The shotgun according to claim 8, wherein the second pipe of said piston includes a threaded inside portion and said shotgun further comprises a ring threadably attached to the threaded portion of said piston, said ring being engaged by said biasing means such that the positioning of said ring along the threaded portion of said piston adjusts the biasing force applied to said control valve means.

13. The shotgun according to claim 1, wherein said piston has an associated smallest inner diameter that is substantially larger than an outer diameter of said magazine tube.

14. The shotgun according to claim 1, wherein said control valve means comprises a pipe situated in a bore of said piston, said pipe being provided, on an inside portion thereof, with a cavity within which at least one sealing O-ring is positioned and an outside portion that is provided with a support ring adapted to sealingly engage an inner surface of said piston.

15. The shotgun according to claim 14, wherein the pipe of said control valve means includes an outer surface provided with a plurality of longitudinally extending ducts for the passage of propulsion gases therethrough.

16. The shotgun according to claim 14, wherein said control valve means terminates in a foremost portion that has an associated outer diameter that is slightly less than an inner diameter of a foremost part of said piston.

* * * * *